US006814091B2

(12) United States Patent
McConnell et al.

(10) Patent No.: US 6,814,091 B2
(45) Date of Patent: Nov. 9, 2004

(54) NIPPLE AND PACIFIER DISHWASHER BASKET

(75) Inventors: Thomas E. McConnell, Santa Ynez, CA (US); Francois Hacquard, Los Angeles, CA (US); Michael E. Henley, Santa Ynez, CA (US)

(73) Assignee: Prince Lionheart, Inc., Santa Clara, CA (US)

( * ) Notice: Subject to any disclaimer, the term of this patent is extended or adjusted under 35 U.S.C. 154(b) by 351 days.

(21) Appl. No.: 10/136,519

(22) Filed: May 1, 2002

(65) Prior Publication Data

US 2003/0205258 A1 Nov. 6, 2003

(51) Int. Cl.[7] ..... B08B 3/02

(52) U.S. Cl. ..... 134/135; 134/166 R; 134/201; 211/181.1; 211/41.8; 220/912

(58) Field of Search ..... 134/135, 166 R, 134/201; 211/181.1, 89.01, 41.8, 41.9; 220/912

(56) References Cited

U.S. PATENT DOCUMENTS

| | | | |
|---|---|---|---|
| 612,625 | A | 10/1898 | Decker |
| 808,834 | A | 1/1906 | Eice |
| 843,826 | A | 2/1907 | Kloeppinger |
| 1,292,935 | A | 1/1919 | Walsh |
| 1,496,957 | A | 6/1924 | Walker |
| 1,527,326 | A | 2/1925 | Owens |
| 1,608,283 | A | 11/1926 | Woolsey |
| 1,618,622 | A | 2/1927 | Woolsey |
| 2,152,456 | A | 3/1939 | Barrie |
| 2,367,448 | A | 1/1945 | Thiele |
| 2,586,005 | A | 2/1952 | Colonna |
| 2,741,392 | A | 4/1956 | Weiss |
| 2,936,898 | A | 5/1960 | Miquez |
| 3,050,073 | A | 8/1962 | McMillan |
| 3,182,854 | A | 5/1965 | Geller |
| 3,289,854 | A | 12/1966 | Kauffman |
| 3,935,958 | A | 2/1976 | Frangos |
| 3,960,290 | A | 6/1976 | Yake et al. |
| 4,058,233 | A | 11/1977 | Frangos |
| 4,157,145 | A | 6/1979 | Jordan |
| 4,192,432 | A | 3/1980 | Jordan |
| 4,193,588 | A | 3/1980 | Doneaux |
| 4,339,051 | A | 7/1982 | Crawford |
| 4,498,594 | A | 2/1985 | Elder |
| 4,512,489 | A | 4/1985 | Green et al. |

(List continued on next page.)

FOREIGN PATENT DOCUMENTS

| | | | |
|---|---|---|---|
| DE | 1 642 159 | | 8/1971 |
| DE | 29 29 227 | | 10/1980 |
| DE | A 46 735 u | | 8/1985 |
| DE | 40 22 269 | * | 1/1992 |

OTHER PUBLICATIONS

European Patent Office 143,754 Jun./1985 (Pletro).*
European Patent Office 186,157 Dec./1985 (Huttemann).*

*Primary Examiner*—Frankie L Stinson
(74) *Attorney, Agent, or Firm*—Stetina Brunda Garred & Brucker

(57) ABSTRACT

A dishwasher basket, having an upper compartment providing a common storage area for various types of accessories and a lower compartment particularly designed for storing baby bottle nipples. The lower compartment has two trays so structured that nipples rest therein with a specific angular orientation to achieve optimal cleaning effect. The dishwasher basket further has a spinning storage compartment insertable between the tray underneath the upper compartment. The spinning storage compartment has at least one rotor therein to rotate about the central axis thereof. The spinning storage compartment may be used to store small articles such as valves of toddler training cups. The angular orientation of the valves relative to the water jet is varied as the rotor rotates, such that the valves can be thoroughly cleaned.

24 Claims, 3 Drawing Sheets

U.S. PATENT DOCUMENTS 4,718,441 A * 1/1988 Daum et al. ..... 134/201
4,732,291 A 3/1988 McConnell
4,748,993 A 6/1988 Llewellyn
4,830,200 A 5/1989 Zambano et al.
4,836,392 A * 6/1989 Constantino ..... 211/133.5
5,209,784 A * 5/1993 Bellman ..... 134/25.4
5,211,191 A * 5/1993 Brown ..... 134/201
D338,749 S 8/1993 McConnell

* cited by examiner

NIPPLE AND PACIFIER DISHWASHER BASKET

CROSS REFERENCE OF RELATED APPLICATION (Not Applicable)

STATEMENT RE: FEDERALLY SPONSORED RESEARCH/DEVELOPMENT (Not Applicable)

BACKGROUND OF THE INVENTION

The present invention relates generally to a storage container, and more particularly, to a basket for storing infant feeding accessories and pacifiers, suitable for use in a dishwasher.

Infant bottle feeding accessories and parts such as nipples, collars, sealing discs and valves require constant cleaning and sanitizing. These items are typically made of plastic and silicone and can be cleaned by various means such as scrub brushes, dishwasher baskets, self-contained plastic appliances with internal heating elements, and/or boiling in water. Using scrub brushes to hand wash the bottle feeding accessories is very laborious. Also, various sizes of the scrub brushes are required for different accessories to provide thorough cleaning. Normally, before sterilizing and boiling water, the bottle accessories must be manually cleaned in advance to remove the tough residual formula baby buildup. The self-contained plastic appliances with internal heating elements, though automatically cleaning and sterilizing the bottle accessories, are very costly and have very limited capacity. Typically, such self-contained plastic appliances can accommodate only a maximum of six bottles at once. Further, after the infants grow older and the bottle accessories are not used any more, such appliances cannot be used for other applications and are therefor not economical.

The prior art dishwasher baskets allow bottle accessories to be cleaned in a normal household dishwasher. The dishwasher baskets are normally relatively inexpensive and can be used for storing other utensils and small kitchenware after the infants grow up. Currently, several types of containers and other types of supports have been proposed. For example, a nipple rack formed of a wire or plastic frame construction has heretofore been used to receive a plurality of nipples disposed in a linear array. Such prior art nipple racks are designed for holding the nipples only and are typically not suitable for holding pacifiers and other accessaries of the baby bottles such as collars and cap rings. The prior art devices designed for holding collars have the similar drawback of being inadequact for holding other articles. In addition, such prior art devices require undue manipulation of the collars to provide a secured storage during the dishwasher cycle. Other prior art basket devices for holding all the bottle accessories including nipples, collars, sealing discs, lids, valves, and pacifiers in the common compartment have also been developed. These devices, although holding the articles securely in the dishwasher, different articles can be present in random orientations in the same compartment resulting in residual water being maintained in various articles after the drying cycle.

Therefore a substantial need in the art exists to provide a container that can hold various types of accessories for baby bottles as well as pacifiers while providing proper washing and cleaning effects for such different articles.

BRIEF SUMMARY OF THE INVENTION

The present invention provides a dishwasher basket, comprising an upper compartment and a lower compartment removably attached to each other. Both the upper compartment and lower compartment are made of heat resistant, preferably polymer plastic material with a plurality of openings allowing water to flow freely therethrough. The upper compartment includes a basket compartment adapted to provide a common storage area for general bottle accessories such as collars, sealing caps, and pacifiers. The sidewalls of the basket have an extension which extends below the bottom surface to define an open space under its bottom surface. The lower compartment includes two parallel trays connected by a central ridge portion. The central ridge portion is preferably sized to extend above the rims of the parallel trays, such that the tips of the nipples stored in the trays rest on the rims. A pair of engaging means are formed extending from the opposing rims to engage with the extension formed on the lower surface of the upper basket. While attaching the lower compartment and the upper compartment, the tips of the nipples are slightly compressed, such that the nipples will be maintained in an inclined orientation most advantageous for proper cleaning and drying and will not shift during the dishwasher cleaning cycle.

Preferably, the basket is placed on the top shelf or rack and positioned over the water jet source in the dishwasher. The nipples thus rest in the trays on an angular inclination relative to the water jet. Further, the tips of the nipples resting in the rims point relatively upwardly, and the open ends of the nipples face relatively downwardly, so that the water jet can contact the inside of the nipple to significantly enhance the cleaning effect and allow proper drying.

The basket may further comprise a spinning storage compartment disposed between the parallel trays of the lower compartment and under the bottom surface of the upper compartment, which may be used to store small articles such as valves of toddler training cups which are difficult to clean. To vary the angular orientation of the valves contained in the spinning storage compartment relative to the water jet, at least one paddle wheel/rotor is mounted to the spinning storage compartment which rotates to agitate and turn the valves.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
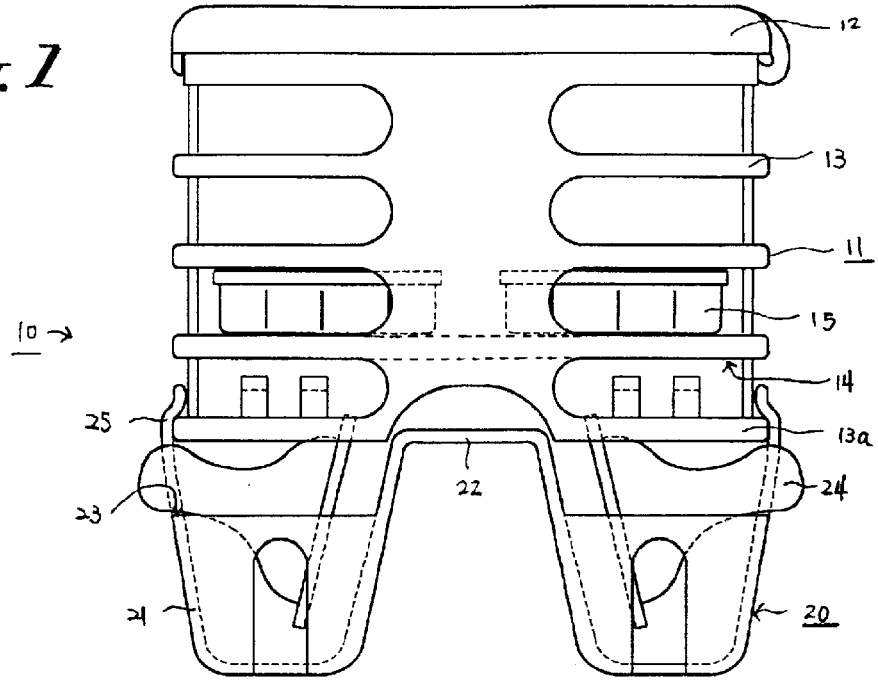
FIG. 1 shows a side view of the assembly of an upper compartment and a lower compartment the dishwasher basket according to the present invention.
Figure 2:
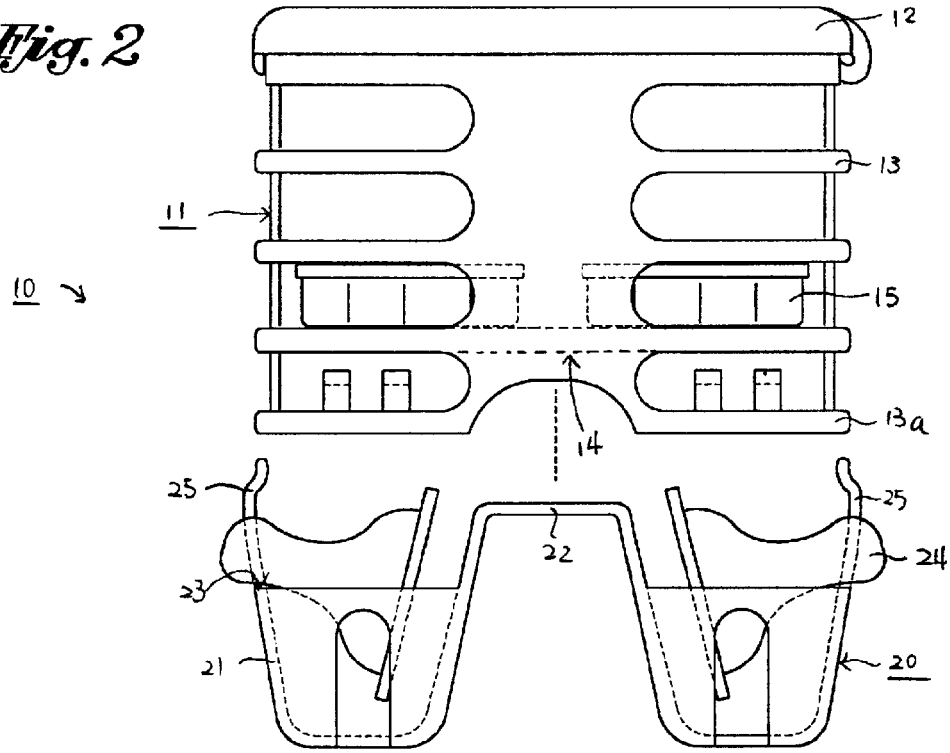
FIG. 2 shows an exploded side view of the upper compartment and the lower compartment of the dishwasher basket according to the present invention.
Figure 3:
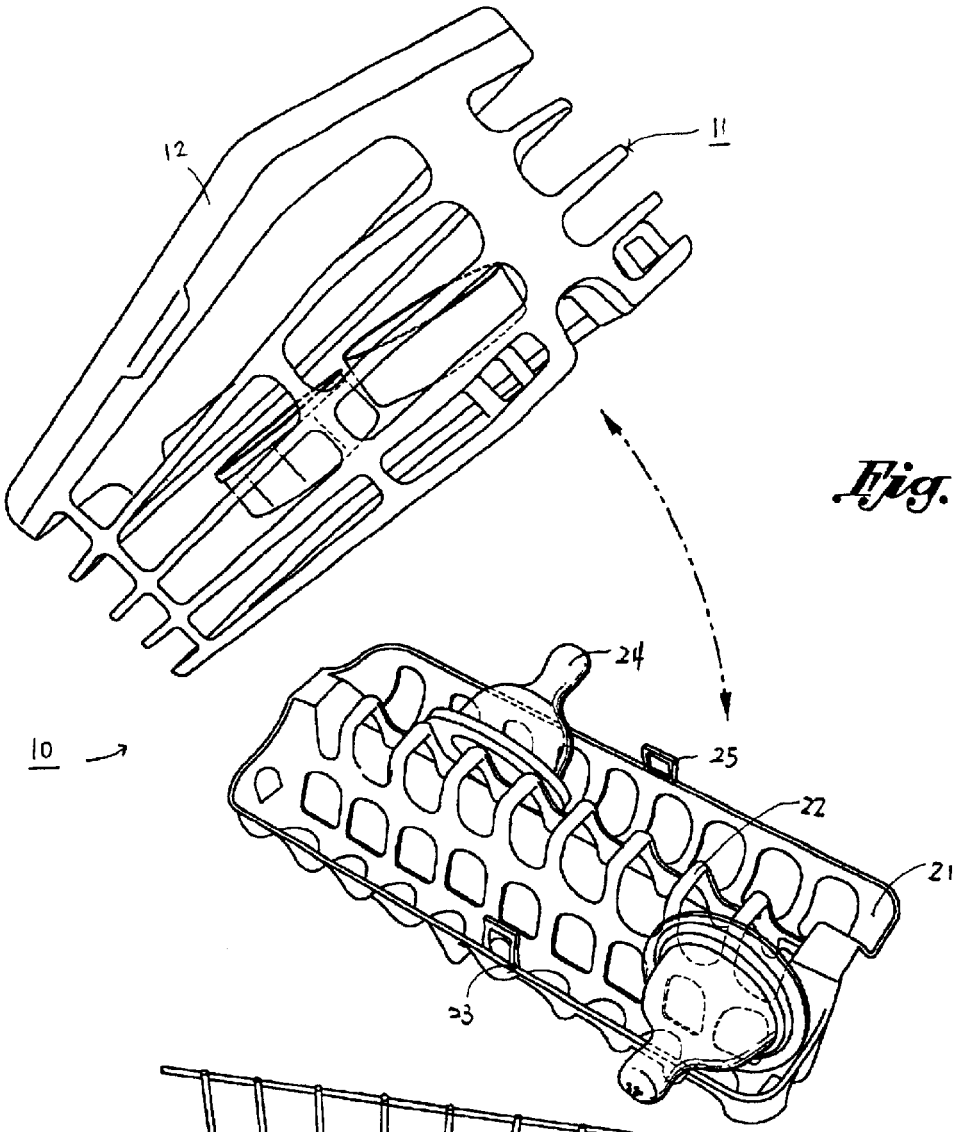
FIG. 3 shows an exploded view of the upper and the lower compartments of the dishwasher basket of the present invention.

FIG. 1 illustrates a side view of a dishwasher basket according to the present invention, FIG. 2 is an exploded side view of the dishwasher basket, and FIG. 3 illustrates the exploded view of the lower and upper compartments of the dishwasher basket. As shown in FIGS. 1, 2 and 3, the dishwasher basket 10 comprises an upper compartment 11 and a lower compartment 20. The upper compartment 11 is, for example, a basket with a common area for storing bottle feeding accessories such as collars and sealing caps, and pacifiers. In FIGS. 1 to 3, exemplary accessories such as bottle collars 15 are stored in the upper compartment 11. The common storage is enclosed by a top lid 12, a bottom surface 14, and a continuous sidewall 13. The top lid 12 is open for loading and/or unloading bottle feeding accessories, and closed for securely storing the accessories for cleaning in a dishwasher. Preferably, the top lid 12, the sidewall 13 and the bottom 14 are made of a heat resistant plastic polymer frame or wire frame having a plurality of openings from which water can flow through freely. Further, the sidewall 13 has an extension extending below the bottom surface 14 to define an open space underneath the bottom surface 14 of the upper compartment 11.

The lower compartment 20 is particularly designed for storing nipples of the feeding bottles. As shown in FIGS. 1 to 3, the lower compartment 22 comprises two parallel trays 21 connected to each other by a central ridge 22. Preferably, the central ridge 22 is sized to extend above the rims 23 of the trays 21 allowing the nipples 24 stored in the trays 21 with the tips thereof resting on the rims 23. The nipples 24 are thus self-aligned in an inclined orientation in the trays 21 merely by manually placing the nipples 24 on the trays 21. Further, the larger open ends of the nipples 24 face relatively downwardly, while the tips of the nipples 24, as mentioned, rest on the rims 23 and point relatively upwardly. At least a pair of resilient members 25 are formed extending from the opposing rims 23 of the trays 21 to engage with the extension 13*a* of the sidewall 13, so as to releasably attach the bottom compartment 20 to the upper compartment 11. Preferably, the upper and lower compartments 11 and 20 are engaged with each other in a snap-on fashion. Similarly to the upper compartment 11, the lower compartment 20, including the trays 21 and the central ridge 22, are made of heat resistant wire frames with a plurality of openings allowing water to freely flow through.

When the lower compartment 20 is engaged with the upper compartment 11 via the resilient members 25, the tips of the nipple resting on the rims 23 are slightly compressed between the rims 23 and the lower edge of the extension 13*a*. Therefore, the nipples 24 will not shift during cleaning, and the angular orientation of the nipples 24 is maintained. The open space defined by the extension 13*a* of the sidewall 13 underneath the bottom surface 14 accommodates the protruding parts of the lower compartment 20. For example, as the central ridge 22 is preferably higher than the rims 23, a space to receive the central ridge 22 is required. Further, when some of the nipples 24 stored in the trays 23 has a larger size, the open space prevents from squeezing and deforming the nipples 24 during cleaning.

Figure 4:
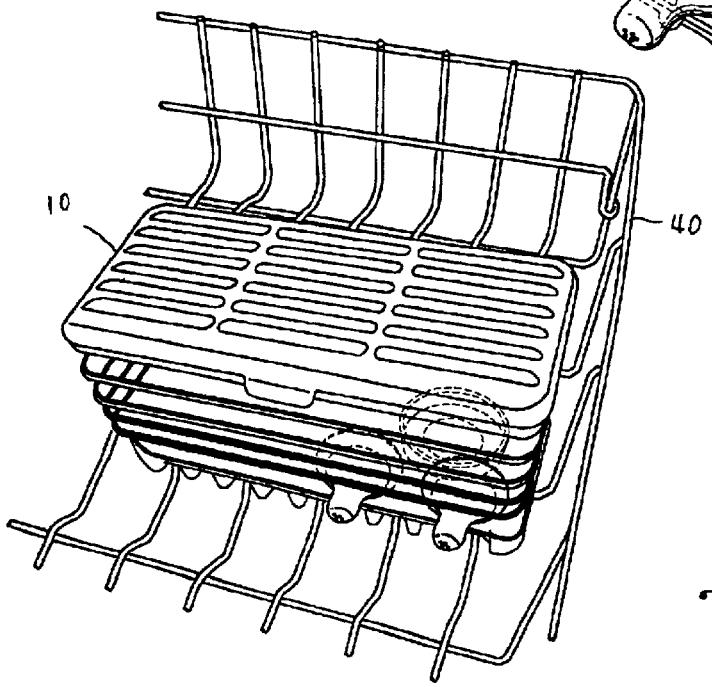
FIG. 4 shows the dishwasher basket with the lower and upper compartments placed in a rack of a dishwasher according to the present invention.

Referring to FIG. 4, after the nipples 24 are self-aligned in the lower compartment 20 with an angle to the horizontal, and the accessories 15 are stored in the upper compartment 11, the dishwasher basket 10 is placed in the dishwasher for cleaning. Preferably, the dishwasher basket 10 is placed in the top shelf or top rack 40 of the dishwasher above the water jet source, such that the nipples 24 are angularly disposed over the water jet source. That is, the larger open ends of the nipples 24 are facing the water jet source with a specific angular orientation, such that water jet is effectively injected to contact the inside of the nipples 24 to provide thorough cleaning. Further, as the tips of the nipples 24 are relatively upward pointing, and the larger open ends of the nipples 24 are relatively downward facing, water will drain via gravity and will not remain in the nipples 24 during the drying cycle.

Figure 5:
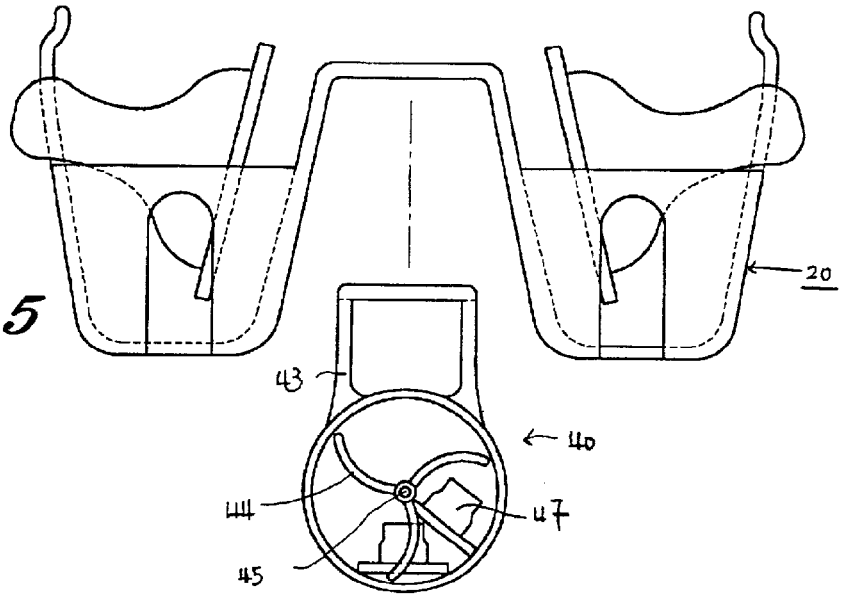
FIG. 5 shows an end view of a spinning storage frame to be assembled with the lower compartment of the dishwasher basket according to the present invention.
Figure 6:
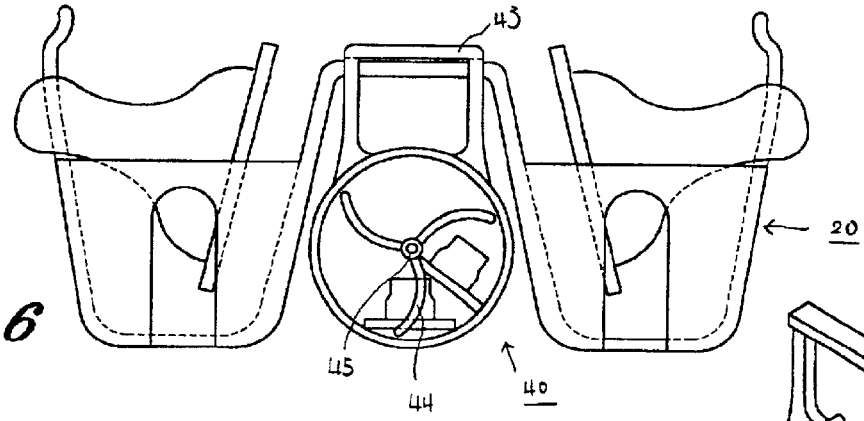
FIG. 6 shows an end view of the assembly of the spinning storage frame and the lower compartment of the dishwasher basket according to the present invention.
Figure 7:
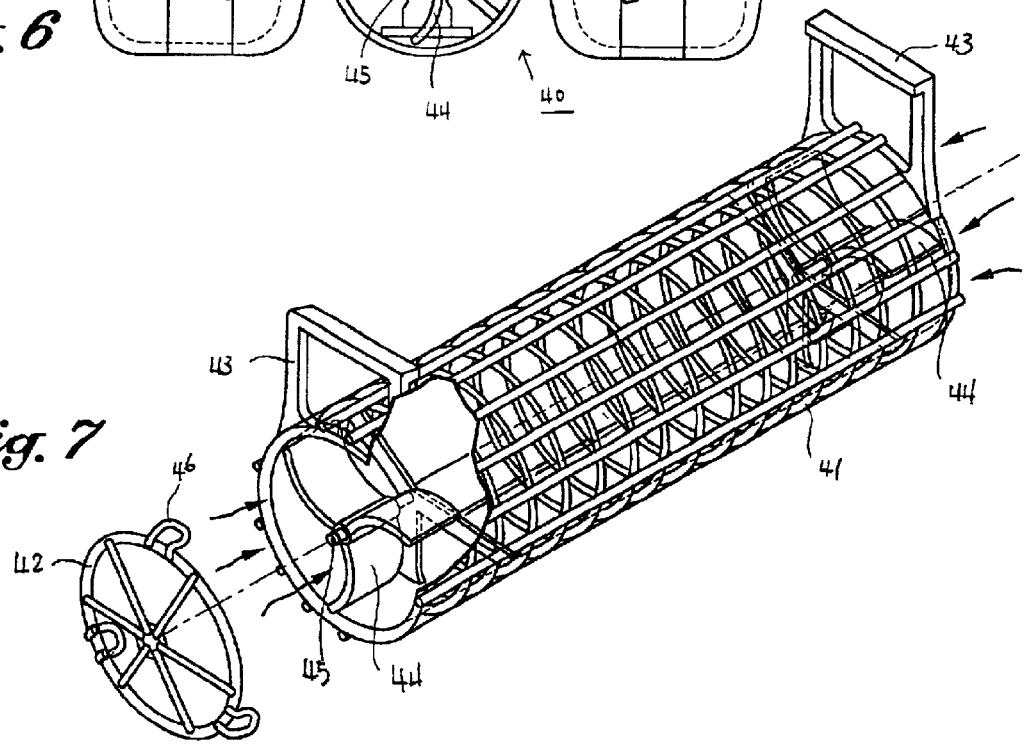
FIG. 7 shows a perspective view of spinning storage compartment of the dishwasher basket according to the present invention.

Referring to FIGS. 5 to 7, the dishwasher basket 10 further may include a spinning storage compartment 40 mounted between the trays 21 and underneath the bottom surface 14 of the upper compartment 11. In FIGS. 5 and 6, side view of the lower compartment 11 and the spinning storage compartment 40 are shown. In FIG. 7, a respective view of the spinning storage compartment 40 is illustrated. The spinning storage compartment 40 comprises a substantially cylindrical frame 41 having two end caps 42. At least one rotor or paddle wheel 44 is mounted to the central axis 45 of the spinning storage compartment 40. As shown in FIGS. 5 to 7, the spinning storage compartment 40 further comprises a pair of attaching means 43 to removably attach the spinning storage compartment 40 with the dishwasher basket 20. Preferably, a snap-on type latch is adapted to attach the spinning storage frame 40 between the trays 20 and underneath the bottom surface 14. It will be appreciated that other types of attaching means or mounts providing similar latching effect can also be applied in the present invention.

As shown in FIG. 7, resilient latch members 46 are formed at the periphery of at least one of the end caps 42, allowing the side end caps 42 removably attached to the cylindrical frame 41. Alternatively, the resilient latch members 46 can be mounted by a hinging means formed at the periphery of the end caps 42 and the cylindrical frame 41. The end caps 42 can be opened for loading/unloading small articles such as valves 47 of toddler training cups and closed after the articles are loaded/unloaded. Preferably, the resilient members 46 includes resilient members such as clasp, clamp, hook and other resilient members.

The spinning storage compartment 40 is preferably made of heat resilient plastic material with a plurality of openings such that water can flow through. When the dishwasher basket 20 including the upper compartment 11, the lower compartment 20 and the spinning storage compartment 40 is placed in the dishwasher, the rotor 45 rotates about the central axis 45 to tumble the small articles/valves 47 disposed within the spinning frame relative the water jet stream during washing cycle. As a result, the nipples 24 in the lower compartment 20 and the accessories 15 in the upper compartment 11 can be more thoroughly cleaned. Further, when the valves 47 are stored in the spinning storage compartment 40, the rotation of the rotor 44 varies the orientation of the valves 47 relative to the injected jet water stream to effectively clean the valves 47.

Indeed, each of the features and embodiments described herein can be used by itself, or in combination with one or more of other features and embodiment. Thus, the invention is not limited by the illustrated embodiment but is to be defined by the following claims when read in the broadest reasonable manner to preserve the validity of the claims.

What is claimed is:

1. A dishwasher basket, comprising:

an upper compartment, having a common storage area for various kinds of accessories; and a lower compartment, further comprising:

two parallel trays for storing at least one nipple;

a central ridge connecting between the parallel trays; and at least a pair of engaging means extending from two opposing parts of the rims of the parallel trays to removably attaching the lower compartment to the upper compartment.

2. The dishwasher basket according to claim 1, wherein the upper compartment further comprising a top lid, a sidewall and bottom surface enclosing the common storage area.

3. The dishwasher basket according to claim 2, wherein the sidewall further comprises an extension extending over the bottom surface to define an open space underneath the bottom surface.

4. The dishwasher basket according to claim 3, wherein the central ridge extends above the rims of the parallel trays is received in the open space.

5. The dishwasher basket according to claim 3, wherein the engaging means includes resilient members to latch with the extension of the sidewall.

6. The dishwasher basket according to claim 3, wherein the central ridge extends above the rims such that the tip of the nipple is resting on the rims and compressed between the rims and the extension when the engaging means is engaged with the extension.

7. The dishwasher basket according to claim 1, wherein the central ridge extends above the rims such that the tip of the nipple stored in the parallel trays rests on the a part of the rims with an inclined orientation.

8. The dishwasher basket according to claim 1, wherein the trays are so designed that the tip of the nipple points relatively upwardly and the open end of the nipple facing relatively downwardly.

9. The dishwasher basket according to claim 1, further comprising a spinning storage compartment attached between the parallel trays under the bottom surface.

10. The dishwasher basket according to claim 9, wherein the spinning storage compartment further comprises a cylindrical frame with two end caps.

11. The dishwasher basket according to claim 9, wherein the spinning storage compartment is in a substantially cylindrical shape for storing at least one valve of toddler training cups spinning during cleaning in a dishwasher.

12. The dishwasher basket according to claim 11, wherein the spinning storage compartment further comprises at least one rotor rotating about the central axis thereof to vary angular orientation of the valve relative water jet during cleaning cycle of the dishwasher.

13. The dishwasher basket according to claim 9, wherein the spinning storage compartment further comprises at least one rotor rotating about the central axis thereof to agitate and circulate water jet during cleaning cycle of the dishwasher.

14. A basket for holding baby feeding accessories allowing a water jet in a dishwasher to flow through, comprises:

an upper compartment, comprising a storage area for storing various kinds of accessories;

a lower compartment attached underneath the upper compartment, the lower compartment further comprising two trays for storing a plurality of self-aligned nipples with an inclined angle to the water jet; and a spinning storage compartment, attached between the trays and underneath the upper compartment.

15. The basket according to claim 14, wherein the upper compartment, the lower compartment and the spinning storage frame are made of heat resistant material with a plurality of openings allowing water jet to flow through freely.

16. The basket according to claim 14, wherein the upper compartment further comprises a top lid, a sidewall and a bottom surface to enclose the storage area.

17. The basket according to claim 16, wherein the sidewall has an extension extending over the bottom surface to define an open space under the bottom surface operative to receive any element protruding over the lower compartment.

18. The basket according to claim 17, wherein the lower compartment further comprises a pair of resilient members for latching with the extension.

19. The basket according to claim 14, wherein the lower compartment further comprises a central ridge connecting between the trays.

20. The basket according to claim 19, wherein the central ridge extends above the rims of the trays, such that the nipples rest in the trays with the inclined angle to the water jet.

21. The basket according to claim 19, wherein the central ridge extends above the rims of the trays, such that the tips of the nipples in the trays point relatively upwardly, and the opening ends of the nipples face relatively downwardly.

22. The basket according to claim 14, wherein the spinning storage compartment is in a substantially cylindrical shape for storing more varieties of accessories.

23. The basket according to claim 22, wherein the accessories include valves of toddler training cups.

24. The basket according to claim 22, wherein the spinning storage compartment comprises at least one rotor rotating about the central axis thereof to vary angular orientation of the accessories relative to the water jet.

* * * * *